United States Patent [19]

Špaček et al.

[11] 4,419,876

[45] Dec. 13, 1983

[54] PRESSURE CONTROL APPARATUS FOR HYDROMECHANICAL DRAWING

[75] Inventors: Jindřich Špaček; Václav Smrček; Karel Voda, all of Brno; Jiří Kosek, Ždár n/Sáz; Jan Hrdina, Ždár n/Sáz; Václav Peňáz, Ždár n/Sáz, all of Czechoslovakia

[73] Assignee: Tovarny strojirenske techniky, koncern, Prague, Czechoslovakia

[21] Appl. No.: 215,915

[22] Filed: Dec. 12, 1980

[30] Foreign Application Priority Data

Dec. 12, 1979 [CS] Czechoslovakia ..... 8664-79

[51] Int. Cl.[3] ..... B21D 39/08

[52] U.S. Cl. ..... 72/57; 72/60; 72/481

[58] Field of Search ..... 72/57, 60–63, 72/481; 92/78

[56] References Cited

U.S. PATENT DOCUMENTS

| | | | |
|---|---|---|---|
| 1,015,913 | 1/1912 | Stratton et al. | 72/481 |
| 2,856,121 | 10/1958 | Buehler | 92/78 X |
| 2,931,497 | 4/1960 | Billen | 72/60 X |
| 3,046,923 | 7/1962 | Yolin | 72/57 |
| 3,491,565 | 1/1970 | Birman | 72/60 |
| 3,596,485 | 8/1971 | Burk | 72/57 |
| 3,614,883 | 10/1971 | Kramer | 72/63 |
| 3,962,895 | 6/1976 | Rydell | 72/63 |

*Primary Examiner*—Leon Gilden

[57] ABSTRACT

Device for the control of the pressure in the pressure chamber for the hydromechanical deep drawing of sheet metal in hydraulic presses wherein the pressure chamber constitutes the drawing die. The control system has at least one two-diametered piston transmitter mounted in a hydraulic cylinder which on the side of the smaller diameter of the piston of the piston transmitter is connected to the space of the pressure chamber and on the other, larger diameter side of the piston transmitter is provided with a supply line for the pressure medium. The control system may include several hydraulic cylinders with two-diameter piston transmitters, the volume of the parallel hydraulic cylinders at the side of the smaller diameters of pistons of the piston transmitters is equal to, or greater than, the volume of the pressing in the pressure chamber.

5 Claims, 3 Drawing Figures

PRESSURE CONTROL APPARATUS FOR HYDROMECHANICAL DRAWING

Figure 1:
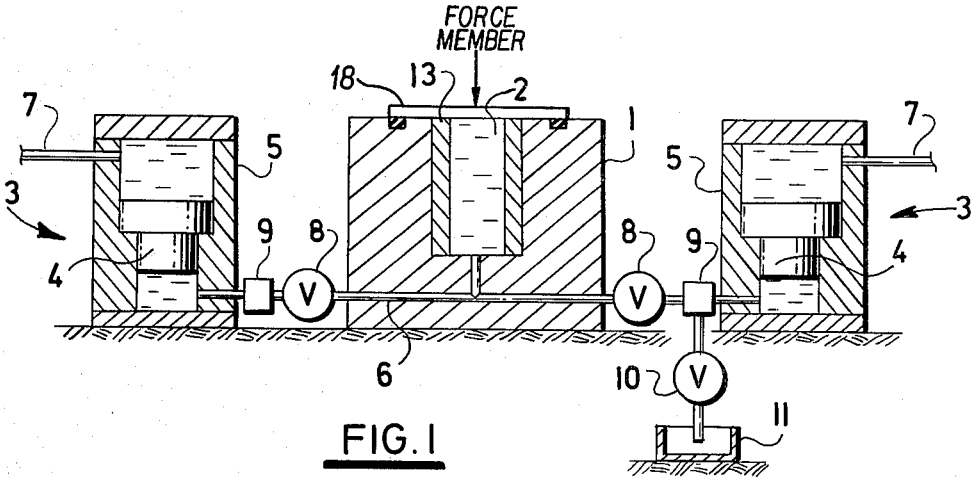

The invention relates to an apparatus for the control of pressure in the pressure chamber of the hydromechanical drawing apparatus, especially for the deep drawing of sheet metal on hydraulic presses wherein the pressure chamber filled with fluid constitutes the drawing die proper.

Known devices for hydromechanical drawing, especially for the deep drawing of sheet metal parts, have distinct advantages over orthodox sheet metal drawing, especially for parts of intricate shape. Hydromechanical drawing usually ensures within a single drawing operation the formation of the pressing of the required shape and a very neat surface of the pressing, due to the fact that the sheet metal does not slide over the edge of the drawing die ring but is being pushed away continuously from the drawing die by the pressure of water inside the latter.

Despite this advantage, the utilization of hydromechanical drawing devices in some cases presented problems due to their energy consumption and also due to the fact that most indispensable hydraulic elements in this device operate under high pressures for which these hydraulic elements have to be specially designed. This circumstance considerably restricts their production and choice, and moreover these elements were lacking in the required universality. A further limiting factor of the device for hydromechanical drawing is the filling fluid for the pressure chamber; this fluid is usually a water emulsion, and because of its insufficient lubricating effects and strong corrosive effects also has a negative influence on the life of the hydraulic elements in the pressure control system for the pressure chamber.

The above mentioned drawbacks have been eliminated by the introduction of a pressure chamber which includes at least two fluid spaces separated from each other by at least one piston transmitter. This arrangement brought the advantage that only one space, i.e. the space directly under the pressing being drawn, remained exposed to the high pressure and all further adverse effects of the water emulsion, while the other space always remains perfectly clean and is under uncomparably lower pressure and thus could be connected to the hydraulic control circuit of the hydraulic press by means of hydraulic elements in current use. This also has brought about a considerable improvement of the balance of energy of the hydraulic press.

A drawback of the improvements introduced with the pressure chambers for hydromechanical drawing resides in that the pressure chamber and the piston transmitter are formed within one body. This body, which contrary to the former pressure chamber has a greater height, therefore restricts to some extent the utilizable working range of the slide stroke of the hydraulic press. A further drawback is the tedious installation of the pressure chamber, as well as the impossibility of efficiently catching the chips which during drawing are separated from the blank of sheet being drawn and collect in the space of the water content of the pressure chamber above the piston of the piston transmitter. Another drawback is the fact that the outer dimensions of the pressure chamber also limit the water content above the piston transmitter, whereby in fact the range of sizes of the pressings is restricted. When a change of the pressing size is necessary, the whole pressure chamber including the piston transmitter has to be replaced; this is a costly operation.

These drawbacks of prior devices for hydromechanical drawing are eliminated by the device for the control of pressure in the pressure chamber according to the present invention. Such device comprises a regulation system with at least one piston transmitter mounted in a hydraulic cylinder which, on the side of the smaller piston diameter of the piston transmitter, is connected with the space of the pressure chamber, and on the other side of the piston transmitter is equipped with a fluid pressure supply line.

The arrangement of the control system with at least one piston transmitter outside the body of the pressure chamber has a special advantage in that the pressure chamber can be interchanged as required according to the size of the pressing to be drawn while leaving the control system unchanged. The control system may thus be arranged to constitute an independent unit, and its function can be organized in suitable combination with logic control elements so that this control system affects the pressure in the pressure chamber with respect to the technology of drawing while retaining the savings of energy requirements of the hydraulic press, etc.

Figure 2:
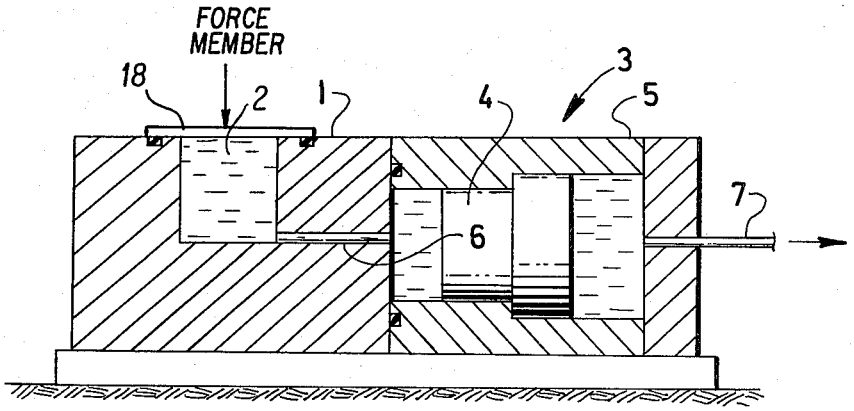
Figure 3:
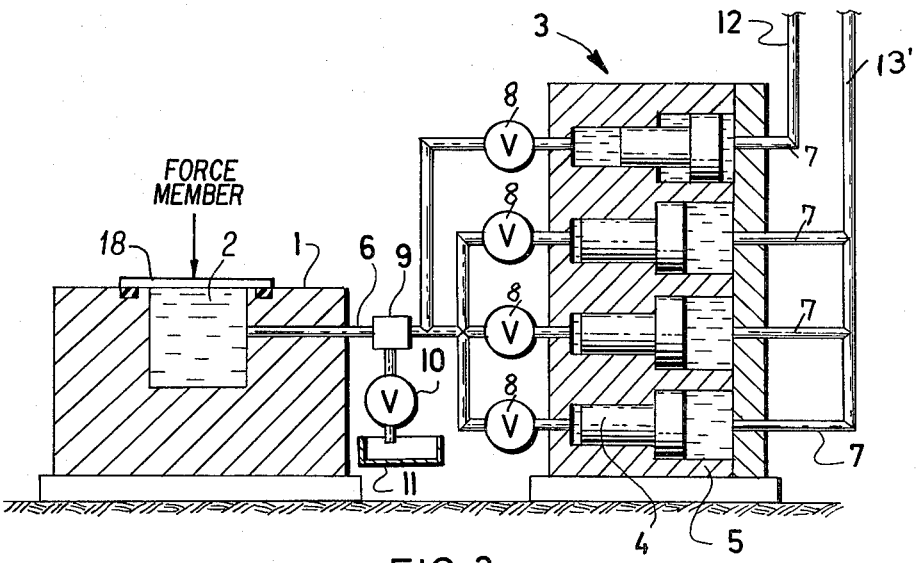

Further advantages of the device for the control of pressure in the pressure chamber according to the invention will appear from the subsequent description and from the accompanying drawings, in which:

FIG. 1 is a view in cross-section of the first embodiment of hydromechanical drawing apparatus in accordance with the invention;

FIG. 2 is a view in section of a second embodiment of hydromechanical drawing apparatus in accordance with the invention; and FIG. 3 is a view in section of a third embodiment of hydromechanical drawing apparatus in accordance with the invention, such embodiment incorporating a modification of the control system shown in FIG. 1 with at least one hydraulic cylinder with an independent supply for the control pressure fluid.

Turning to the first illustrative embodiment of the apparatus shown in FIG. 1, such figure shown a hydromechanical apparatus for the deep drawing of pressings, said apparatus including a first embodiment of control system in accordance with the invention. The hydromechanical apparatus has a chamber 1, which has a liner or sleeve 13 which defines the inner profile and volume of the chamber, and is filled with a water emulsion 2, as shown. The drawing apparatus has a hydraulic cylinder 15 supported upon chamber 1 coaxial of sleeve 13, cylinder 15 being retained on chamber 1 by a member **1*b*. The lower end of cylinder 15 functions as a hold-down for a sheet metal blank 18 to be deep drawn, the rim of blank 18 overlying a sealing means 1*c* disposed in a groove in the upper surface of chamber 1. A piston 16 reciprocable in cylinder 15 is thrust downwardly by fluid under pressure fed into cylinder 15 above such piston from a source of fluid pressure (not shown). Piston 16 carries a punch or male tool 17 disposed coaxial of sleeve 13, such tool deforming and deep drawing the metal blank 18 as the piston 16 and tool 17** descend.

The pressure control apparatus has two control systems 3, each containing a piston transmitter 4 mounted in a hydraulic cylinder 5 which is separate from the pressure chamber 1. On the side of the smaller diameter of the piston 4, there is a conduit 6 leading to the space within the pressure chamber 1. Each of the hydraulic cylinders 5 of the piston transmitters is provided on its upper end containing the larger diameter of the piston transmitter 4 a connection 7 for supplying the control pressure fluid, preferably hydraulic oil and the like. Interposed in the conduit 6 between each hydraulic cylinder 5 and the pressure chamber 1 there is a filter 9 and a controllable opening valve 8. A further conduit is connected to one of the filters 9 and leads to a sump 11, there being a sludge valve 10 interposed in such further conduit. The lining or sleeve 13 for the pressure chamber 1 may be exchangeable in order to be able to form sheet metal parts of different dimensions.

In FIG. 2, there is shown an apparatus wherein a control system 3 is disposed immediately adjacent to the pressure chamber 1 and forms an assembly therewith. The same reference characters as those used in FIG. 1 are employed in FIG. 2 to designate parts which are similar to those shown in FIG. 1.

In FIG. 3, wherein the same reference characters are employed to designate parts similar to those shown in FIGS. 1 and 2, a plurality of piston transmitters 4 each having a cylinder 5 are contained in a single block. At least one of said piston transmitters 4 (the uppermost one in the figure) is provided with an independent supply line 12, the remaining piston transmitters 4 being provided with a common supply line 13' for supplying control pressure fluid such as hydraulic oil and the like to the piston transmitters 4 thereof. The volume of the hydraulic cylinders 5 on the side of the smaller diameters of the piston transmitters is equal to, or greater than, the volume of the pressings in the pressure chamber 1, or is equal to the volume of the water emulsion 2 displaced from pressure chamber 1. The supply line 7 of the control pressure medium for the three lowermost hydraulic cylinders 5 of the control system 3 may be connected by a control throttle valve (not shown) to the hydraulic unit with a (not shown) main working cylinder of the hydraulic press for actuating the punch or male member of the drawing apparatus.

The apparatus in accordance with the invention operates as follows:

On the upper edge of the pressure chamber 1 there is placed a sheet metal blank 18 for the future pressing, the blank being loaded along the circumference by blankholder 1*b*. Before this, the profile and volume of the pressure chamber 1 is, if required, defined by the exchangeable sleeve element 13. Due to the drawing punch 17 entering into the sealed space of the pressure chamber 1 the pressure of the water emulsion 2 is raised; this produces the well-known effect of hydromechanical drawing, which is suitable especially for the deep drawing of sheet metal.

The pressure of the water emulsion 2 in the pressure chamber 1 at the beginning of the drawing operation may be increased by the action of the one or more transmitters 4 in their hydraulic cylinders 5 equipped with an independent supply line of control pressure medium. It is thus possible, for example, to ensure a precise shaping of the pressing at the front face of the drawing punch at the beginning of the drawing operation and to eliminate the danger of rupture of the pressing due to the material being "extracted" from the wall of the pressing in the further course of the drawing process when the pressure of the water emulsion 2 attains the operation values.

During the drawing process, the water emulsion 2 is displaced from the pressure chamber 1 and flows through the conduit 6 into the one or more hydraulic cylinders 5 of the control system 3 where it exerts pressure on the smaller diameters of the pistons of the piston transmitters 4. The piston transmitters 4 under this pressure recede while being controlled by the counter-pressure of the control pressure medium, e.g. hydraulic oil which is at the same time at a certain pressure differential released through the supply line 7 back via a controlled throttle valve (not shown) into the hydraulic unit of the main working cylinder of the hydraulic press. The energy balance of the drawing apparatus is thus improved.

The water emulsion 2 being released is filtered in filters 9 and metal chips produced in the process of drawing are caught on the bottom of the cavity of the pressure chamber 1 from which they can be readily removed after decompression; in such position they cannot cause seizing or the like. Depending upon the size of the pressure chamber 1 or the volume of the pressing being drawn, certain hydraulic cylinders 5 of the control system 3 may be disconnected by closing valves 9; the control system thus adapted creates optimum conditions for the respective pressure in the pressure chamber 1 for the hydromechanical drawing.

Although the invention in illustrated and described with reference to a plurality of preferred embodiments thereof, it is to be expressly understood that it is in no way limited to the disclosure of such preferred embodiments but is capable of numerous modifications within the scope of the appended claims.

We claim:

1. In a hydromechanical drawing apparatus for the deep drawing of sheet metal in hydraulic presses having a pressure chamber in which the pressure chamber constitutes the drawing die, the improved device for the control of the pressure in the pressure chamber comprising a control system with a plurality of two-diameter piston transformers connected at the small diameter side to the pressure chamber and at the large diameter side to a fluid pressure supply line, wherein the said transformers' outputs are each valved to the pressure chamber, at least one of these outputs being closable independently of the others, and that furthermore the forming pressure chamber contains at least one interchangeable liner member to provide optional pressure chamber valumes, said transformers being selectively utilized dependend upon the liner selected.

2. Apparatus as claimed in claim 1, wherein the counterpressure circuit contains a pressure transformer whose overall volume of pressure space at the side connected to the pressure chamber corresponds substantially to the volume of that chamber.

3. Device as claimed in claim 1, wherein the counterpressure circuit contains a plurality of pressure transformers whose overall volume of pressure space at the side connected to the pressure chamber corresponds substantially to the volume of that chamber, and the volume of each of them corresponds to the least selected volume of the female die of said chamber.

4. Device as claimed in claim 2, wherein the counterpressure circuit contains a plurality of pressure transformers whose overall volume of pressure space at the side connected to the pressure chamber corresponds substantially to the volume of that chamber, and the volume of each of them corresponds to the least selected volume of the female die of said chamber.

5. A device as claimed in claim 1, wherein the control system includes a plurality of parallel connected hydraulic chambers with piston transmitters, the total volume of the parallel hydraulic cylinders at the side of the smaller diameters of pistons of the piston transmitters is equal to, or greater than, the volume of the pressing in the pressure chamber.

* * * * *